United States Patent [19]

White

[11] 3,931,842

[45] Jan. 13, 1976

[54] GOLF TUBE COLLAR

[76] Inventor: David John White, 8 Birches Close, Crowborough Sussex, England

[22] Filed: June 18, 1974

[21] Appl. No.: 480,321

[30] Foreign Application Priority Data

June 20, 1973 United Kingdom ..... 29281/73

[52] U.S. Cl. ..... 150/1.5 R

[51] Int. Cl.[2] ..... A63B 55/00

[58] Field of Search ..... 150/1.5 R, 1.5 A, 1.5 B, 150/52 R; 206/315; 273/32 B, 32 E, 77 R, 77 A; 277/207 A, 208; 285/110; 403/243, 372

[56] References Cited

UNITED STATES PATENTS

| | | | |
|---|---|---|---|
| 1,967,985 | 7/1934 | Wolcott | 285/110 X |
| 2,879,819 | 3/1959 | Turnbull | 150/1.5 R |
| 2,938,559 | 5/1960 | Harkrader | 150/1.5 R |
| 3,164,185 | 1/1965 | Ingoldt | 150/1.5 R |
| 3,534,795 | 10/1970 | Wiedenmeier | 150/1.5 R |
| 3,664,399 | 5/1972 | Neff | 150/1.5 R |
| 3,740,083 | 6/1973 | Zenhausern | 403/243 |
| 3,829,107 | 8/1974 | Machado et al. | 277/207 A |

*Primary Examiner*—William Price
*Assistant Examiner*—Steven E. Lipman
*Attorney, Agent, or Firm*—Behr & Woodbridge

[57] ABSTRACT

A collar for a golf bag tube, comprising an annular member having axially directed inner and outer surfaces, and a plurality of axially spaced projections on said external surface.

3 Claims, 1 Drawing Figure

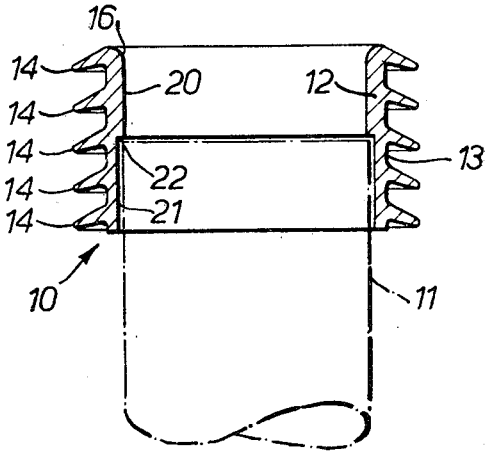
16
14
14
14
14
14
20
12
13
22
21
10
11

GOLF TUBE COLLAR

This invention relates to golf bag tubes.

Golf bag tubes are inserted in golf bags so that each golf club carried is located in its own tube in this way avoiding damage to the grip of the golf club due to interference between the grips at the bottom of the bag. Such tubes have, however, proved less popular than might have been imagined because it is all too easy, when withdrawing a club from the bag, to withdraw also the tube, making it difficult to remove the club from the tube and requiring the subsequent re-insertion of the tube into the bag.

It is an object of the present invention to obviate or mitigate these difficulties.

The present invention is a collar for a golf bag tube, comprising an annular member having axially directed inner and outer surfaces, and a plurality of axially spaced projections on said external surface.

Preferably said projections are circumferential flanges.

The collar may be a plastics moulding.

Said inner surface may comprise a first part and a second part of lesser diameter, a radially extending step being provided between said parts to engage the end of a tube.

The diameters of said first and second parts may be respectively greater than and less than 1½ inches.

One end face may be formed as a bevelled lip leading into the collar.

The surfaces of said projections facing said one end face, may slope outwardly away from said one end face.

The present invention is also a golf bag tube having mounted at one end thereof a collar as defined in any of the last seven preceding paragraphs.

The present invention is further a golf bag tube having at one end a plurality of axially spaced projections on the external surface thereof.

An embodiment of the present invention will now be described, by way of example, with reference to the accompanying drawing, the single feature of which is axial cross-section through a collar according to the present invention.

Referring now to the drawing a collar 10 for a golf bag tube (indicated at 11) is moulded from a plastics material and comprises an annular member 12 having an outer axially directed surface 13 from which project a plurality of axially spaced projections. In this embodiment there are five such projections in the form of circumferential flanges 14, and it should be noted that the upper surfaces of the flanges slope outwardly away from the upper end of the collar.

Also, the upper end of the collar is provided with a bevelled lip 16 leading into the collar.

The internal surface of the collar is divided into two parts 20 and 21 of different diameters by a radially extending step 22. The lower part 21 of the internal surface has the greater diameter and is dimentioned to be a sliding or a force fit on a standard golf bag tube which has a standard outer diameter of 1½ inches. The step 22, in use, engages the end of a tube and the upper part 20 of the internal surface of the collar is then flush with the inner surface of the tube.

In use the collar is secured, as by glueing, onto the end of a golf bag tube and, when the tube is inserted into a bag the flanges 14 ride over and engage the flanges of adjacent tubes so that the nest of tubes in the bag is interlocked. Thus it becomes much more difficult to withdraw accidentally a tube from the bag.

The embodiment described may be modified as by varying the number of flanges though between four and six flanges is thought to be the optimum range. Furthermore, instead of being produced as a separate item, a collar according to the present invention could be formed integrally with a golf bag tube.

What is claimed is:

1. A collar for a golf bag tube comprising:

a plastic annular member having a first and second open end and including axially directed inner and outer surfaces;

said outer surface including a plurality of axially spaced projections thereon, said projections comprising circumferential flanges which slope away from said first open end of said plastic member; and, said inner surface including a first part and a second part of lesser diameter, the first and second part including a radially extending step therebetween for engaging the end of said golf bag tube.

2. A collar as claimed in claim 1, in which the diameters of the first and second parts is respectively greater than and less than 1½ inches.

3. A collar as claimed in claim 2, in which one end is formed as a bevelled lip leading into the collar.

* * * * *